US007899365B2

(12) United States Patent
Maeshima et al.

(10) Patent No.: US 7,899,365 B2
(45) Date of Patent: Mar. 1, 2011

(54) IMAGE FORMING APPARATUS FOR FORMING A COLOR IMAGE THAT PROHIBITS IMAGE STAINING AND CONTAMINATION OF TONERS IN DIFFERENT COLORS WITH SCATTERED TONER

(75) Inventors: Masanobu Maeshima, Osaka (JP); Yoshihiro Yamagishi, Osaka (JP)

(73) Assignee: Kyocera Mita Corporation (JP)

( * ) Notice: Subject to any disclaimer, the term of this patent is extended or adjusted under 35 U.S.C. 154(b) by 1012 days.

(21) Appl. No.: 11/725,758

(22) Filed: Mar. 20, 2007

(65) Prior Publication Data

US 2007/0223968 A1 Sep. 27, 2007

(30) Foreign Application Priority Data

Mar. 22, 2006 (JP) ..... 2006-078934

(51) Int. Cl.
*G03G 15/01* (2006.01)

(52) U.S. Cl. ..... 399/227; 399/274; 399/284

(58) Field of Classification Search ..... 399/227, 399/274, 284

See application file for complete search history.

(56) References Cited

U.S. PATENT DOCUMENTS

| | | | | |
|---|---|---|---|---|
| 5,698,354 | A * | 12/1997 | Ugai et al. | 430/45.54 |
| 5,840,457 | A | 11/1998 | Urawa et al. | |
| 2004/0072087 | A1 * | 4/2004 | Matsunaga et al. | 430/45 |

FOREIGN PATENT DOCUMENTS

| | | |
|---|---|---|
| JP | 9-15925 | 3/1997 |
| JP | 10-97098 | 10/1998 |
| JP | 2001-134045 | 5/2001 |
| JP | 2003-107829 | 4/2003 |
| JP | 2005-316204 | 11/2005 |

* cited by examiner

*Primary Examiner* — David M Gray
*Assistant Examiner* — Laura K Roth
(74) *Attorney, Agent, or Firm* — Gerald E. Hespos; Michael J. Porco

(57) ABSTRACT

An image forming apparatus for forming a color image has developing devices with different color toners. Each developing device has a toner carrier and a layer thickness-controller facing the carrier. Circularity of toner in a particular color is smaller than that of toners in other colors. The layer thickness-controllers of the developing devices containing toners in other colors contact the carrier at a particular linear pressure. Additionally, the coefficient of variance (CV value) of the particle diameter distribution of toner in a particular color may be defined by the formula $$CV\ \text{VALUE} = \frac{\left(\begin{array}{c}\text{STANDARD DEVIATION OF VOLUME} - \\ \text{AVERAGE PARTICLE DIAMETER DISTRIBUTION}\end{array}\right)}{\left(\begin{array}{c}\text{ARITHMETIC VOLUME} - \\ \text{AVERAGE PARTICLE DIAMETER}\end{array}\right)} \times 100$$

and may exceed the CV value of the toners in other colors. The image forming apparatus contains the contaminating toner in the developing device, makes the image resistant to color mixing, and reduces image staining, even if there is leakage of a toner and contamination of the toners in different colors with the scattered toner.

13 Claims, 1 Drawing Sheet

IMAGE FORMING APPARATUS FOR FORMING A COLOR IMAGE THAT PROHIBITS IMAGE STAINING AND CONTAMINATION OF TONERS IN DIFFERENT COLORS WITH SCATTERED TONER

BACKGROUND OF THE INVENTION

1. Field of the Invention

The present invention relates to an image forming apparatus for forming a color image.

2. Description of the Related Art

In a known image forming method using electrophotographic process, a color image is formed in the following manner.

An electrostatic latent image is first formed on a latent image-holding member, and the electrostatic latent image is developed to a developed toner image with a developing device. The developed toner image is then transferred onto an intermediate transfer medium. The electrostatic latent images for different toner colors are consecutively formed and developed, and the developed images are transferred superimposed on the intermediate transfer medium, to form a full color toner image. The full color toner image transferred on the intermediate transfer medium is then transferred on a recording medium such as paper, and then fixed thereon.

The image forming apparatus of forming a color image by the method had a problem of the contamination of color toners in developing devices due to incorporation of one color toner to the other color toners and the resulting color mixing which is caused by scattering of the one color toner from both terminals of the toner carrier in the developing device or from the toner-supplying port during replenishment of the toner into the developing device.

In particular, in a rotary development system of placing a rotary development unit containing multiple developing devices at a position facing a latent image-holding member, moving one of the multiple developing devices selectively to the position facing the development position of the latent image-holding member by rotation of the rotary development unit, and developing the electrostatic latent image with a toner by rotating the toner carrier in the developing device and applying a development bias, such color mixing occurs more frequently, because the position of the developing devices vary.

For example, when a black image is developed in such a rotary development system, a black developing device moves to the position facing the latent image-holding member by rotation of the rotary development unit. A black toner carrier is rotated more frequently because the black image is printed more frequently than images in other colors. As a result, the black toner is scattered more frequently from both terminals of the toner carrier. In addition, the black toner is replenished frequently, making easier scattering of the toner also from the toner-supplying port. When a color image in cyan, magenta, and yellow is developed, for example, the developing device in each color moves to the position facing the latent image-holding member by further rotation of the rotary development unit, the black toner scattered from the black developing device deposits easily on the developing carrier in the developing device in other color by rotation of the rotary development unit. When the black toner deposits on the developing carrier of other color toner, the black toner causes color mixing in the color image area, leading to image staining.

A method of improving the apparatus was proposed for prevention of the toner leakage. For example, Patent Document 1 (Japanese Unexamined Patent Publication No. 2001-134045) and Patent Document 2 (Japanese Unexamined Patent Publication No. 2005-316204) disclose image forming apparatuses in which the sealing efficiency of the rotation part for the toner-supplying unit placed outside a developing device is improved and the drive load of the rotary development unit during rotation is lowered. However, improvement in seal efficiency leads to increase of the load to the rotary development unit, making it difficult to prevent toner leakage completely.

On the other hand, for example, Patent Document 3 (Japanese Unexamined Patent Publication No. 2003-107829) discloses a method of using polymerized toners as color toners and a grinded toner as black toner. However, the method is effective in preventing staining of the fixing part, but not so effective in preventing the image staining caused by contamination of the toner in developing devices. Alternatively, for example, Patent Document 4 (Japanese Patent 3347646) and Patent Document 5 (Japanese Unexamined Patent Publication No. 9-15925) disclose methods of using a magnetic component as black toner and nonmagnetic toners as color toners, but none of the methods could not solve the problem of image staining caused by color mixing in the color-developing device.

SUMMARY OF THE INVENTION

An object of the present invention is to provide an image forming apparatus for forming a color image that prohibits image staining in the color image obtained even when there are leakage of a toner and contamination of the toners in different colors with the scattered toner.

An aspect of the present invention is an image forming apparatus of forming a color image, comprising multiple developing devices each containing a toner different in color, wherein: each of the developing devices has a toner carrier and a layer thickness-controlling part placed at the position facing the toner carrier; among the toners different in color, the circularity of the toner in a particular color is smaller than that of the toners in the other colors; and the layer thickness-controlling parts of the developing devices containing the toners in the other colors are in contact with the toner carrier at a particular linear pressure.

Another aspect of the present invention is an image forming apparatus of forming a color image, comprising multiple developing devices each containing a toner different in color, wherein: each of the developing devices has a toner carrier and a layer thickness-controlling part placed at the position facing the toner carrier; among the toners different in color, the coefficient of variance (CV value) of the particle diameter distribution of the toner in a particular color defined by the following Formula (1) is larger than that of the toners in the other colors; and the layer thickness-controlling parts of the developing devices containing the toners in the other colors are in contact with the toner carrier at a particular linear pressure.

$$CV\ \text{VALUE} = \frac{\left(\begin{array}{c}\text{STANDARD DEVIATION OF VOLUME} - \\ \text{AVERAGE PARTICLE DIAMETER DISTRIBUTION}\end{array}\right)}{\left(\begin{array}{c}\text{ARITHMETIC VOLUME} - \\ \text{AVERAGE PARTICLE DIAMETER}\end{array}\right)} \times 100 \quad (1)$$

DETAILED DESCRIPTION OF THE PREFERRED EMBODIMENTS

Figure 1:
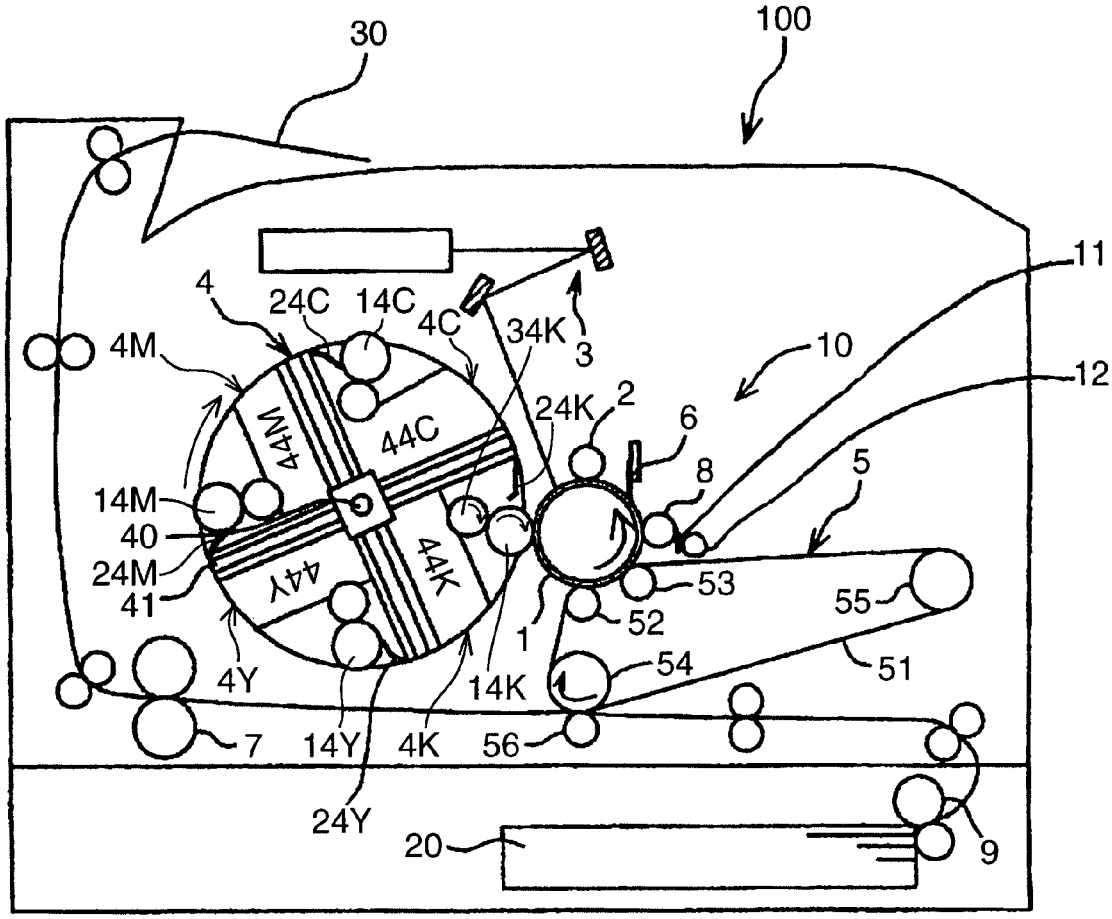
FIG. 1 is a schematic view of the image forming apparatus in an embodiment of the present invention.

An embodiment of the image forming apparatus according to the present invention will be described with reference to FIG. 1.

The image forming apparatus 100 shown in FIG. 1 is a so-called 1-drum/4-cycle rotary multicolor-developing unit 4 having four developing devices 4K, 4C, 4M and 4Y developing images in four colors and a photosensitive drum 1, wherein a particular developing device is moved selectively by rotation to the position facing the photosensitive drum 1 and develops the latent image on the photosensitive drum 1.

The image forming apparatus 100 has an image forming unit 10 almost at the center of the image forming apparatus 100. The image forming unit 10 has a photosensitive drum 1 and a charging means 2, a light-exposure means 3, a rotary multicolor-developing unit 4, a transfer device 5, a roller 8, and a cleaning blade 6 formed around the photosensitive drum 1 along the traveling direction. A fixing unit 7 is placed at the position downstream of the photosensitive drum 1 in the paper-conveying direction. A paper-feeding unit 20 is placed beneath the image forming apparatus 100, and a paper supply roller 9 is placed at the position downstream of the paper-feeding unit 20 in the paper-feeding direction.

The rotary multicolor-developing unit 4 has developing devices (4K, 4C, 4M, 4Y) forming a toner image by supplying a toner to the surface of the photosensitive drum 1 on which the electrostatic latent image is formed.

In FIG. 1, 4K represents a black color-developing device, 4C a cyan color-developing device, 4M a magenta color-developing device, an 4Y a yellow color-developing device, and each of them is held aligned along the peripheral direction of the rotary rack 41, and the developing devices next to each other are placed at an interval of approximately 90 degrees in the peripheral direction. The rotary rack 41 is rotated around the rotating shaft 40 by a rotating means not shown in the FIGURE, bringing each of the multiple developing devices 4K, 4C, 4M, and 4Y to the developing position facing the photosensitive drum 1 for development. Each developing device has a development roller 14K, 14C, 14M, or 14Y as its toner carrier.

In addition, layer thickness-controlling parts 24K, 24C, 24M, and 24Y are placed respectively at positions facing the development rollers 14K, 14C, 14M, and 14Y.

The toner tank 44K contains a black toner; the toner tank 44C, a cyan toner; the toner tank 44M, a magenta toner; and the toner tank 44Y, a yellow toner.

A toner-supplying roller 34K revolving in the direction indicated by the arrow in FIG. 1 supplies the black toner stored in the toner tank 44K to the development roller 14K. The development roller 14K revolving in the direction indicated by the arrow supplies the black toner held on the surface of the development roller 14K to the photosensitive drum 1. Then, the black toner carried on the peripheral face of development roller 14K is controlled to thin layer thickness and favorable uniformity during passage through the slit between the layer thickness-controlling part 24K and the peripheral face of the development roller 14K. The toner is then sent onto the peripheral face of the photosensitive drum 1, as the layer thickness is controlled. Operations in the cyan color-developing device 4C, magenta color-developing device 4M, and yellow color-developing device 4Y are the same as those in the black developing device 4K, and thus, description thereof is omitted.

In the rotary multicolor-developing unit 4, a particular developing device is brought to the position facing the photosensitive drum 1 during development, by revolution of the rotary rack 41.

Generally, black images are more frequently printed than images in other colors. Thus, the rotation frequency of the development roller 14K is greater than those of the other development rollers, and the black toner is scattered more easily from both terminals of the development roller 14K. In addition, the toner is replenished frequently to the black color-developing device 4K, and thus, the black toner may be scattered more easily from the toner-supplying port not shown in the FIGURE. As described above, the scattered black toner deposits on the development rollers 14C, 14M, and 14Y respectively exposing out of other developing devices 4C, 4M, and 4Y.

In such a rotary multicolor-developing unit 4, even if the scattered black toner deposits on the developing device 4C, 4M, or 4Y, it is possible to prevent migration of the black toner through the layer thickness-controlling part and to contain the deposited toner in the developing device, by making the circularity of the black toner smaller than that of the toners in other colors and bringing the layer thickness-controlling parts 24C, 24M, and 24Y other than the layer thickness-controlling part 24K in the black color-developing device 4K respectively into contact with the corresponding development rollers 14C, 14M, and 14Y under a particular linear pressure.

Specifically, the black toner migrated into the developing devices 4C, 4M, or 4Y is blocked by a layer thickness-controlling part 24C, 24M, or 24Y in contact with each development roller, by revolution of the development roller 14C, 14M, or 14Y. On the other hand, the toners in other colors, which are more circular and thus more flowable, are conveyed through the slit between the layer thickness-controlling part and the development roller by the development rollers 14C, 14M, and 14Y. Thus, the black toner deposited in the each developing device in other color is contained in each developing device and thus less transferred onto the development roller, preventing migration of the black toner deposited on the development rollers 14C, 14M, and 14Y onto the photosensitive drum 1 and development of the black toner. As a result, images in mixed color are less easily formed.

Preferably, each layer thickness-controlling part 24C, 24M, or 24Y is in contact with a development roller 14C, 14M, or 14Y under a particular linear pressure, while the layer thickness-controlling part 24K is not in contact with the development roller 14K.

The layer thickness-controlling part 24K, 24C, 24M, or 24Y is preferably a part formed with a metal material such as stainless steel plate or spring steel plate or a rubber material such as silicone rubber, for example, in the shape of blade. For example when formed with such a metal material, the layer thickness-controlling part has a thickness of approximately 0.1 to 0.2 mm. When each layer thickness-controlling part is brought into contact with the development roller, they are preferably connected to each other under a linear pressure of approximately 0.1 to 0.6 Kg/mm, preferably 0.17 to 0.5 Kg/mm.

The circularity of the toner particles is obtained by dividing the sum of particle circularities calculated according to the following Formula (2) by the total number of the particles measured.

CIRCULARITY a = Lo/L (2)

[IN FORMULA (2), Lo REPRESENTS THE PERIPHERAL LENGTH OF A CIRCLE HAVING A PROJECTION AREA IDENTICAL WITH THAT OF THE PROJECTED PARTICLE IMAGE; AND L REPRESENTS THE PERIPHERAL LENGTH OF THE PARTICLE IMAGE]

The circularity is determined, for example by using a flow particle image analyzer (FPIA-2100: manufactured by Sysmex), in the following manner.

A projected image of each toner particle is obtained, and the peripheral length thereof is determined. Assuming a sphere having the same particular projection area, the diameter thereof (circle-equivalent diameter) is determined. The peripheral length of the circle having the circle-equivalent diameter obtained is then calculated, and the circularity of each particle is determined according to Formula (2). The circularity is calculated by dividing the sum of the circularities of particles by the total number of the particles measured.

The difference between the circularity of the black toner and that of the toner in other color is preferably 0.01 or more, because the rate of the black toner being blocked by the layer thickness-controlling part is improved. The circularity of the black toner is preferably 0.90 to 0.94, and the circularity of the toners in other colors is preferably in the range of 0.94 to 0.99.

Preferably in the present embodiment, the black toner supplied to the black color-developing device 4K has a coefficient of variation of particle diameter distribution (CV value) defined by the following Formula (1) larger than that of the cyan, magenta, and yellow toners supplied to the developing devices 4C, 4M, and 4Y, and the layer thickness-controlling parts 24C, 24M, and 24Y are respectively in contact with the development rollers 14C, 14M, and 14Y.

$$CV\ \text{VALUE} = \frac{\left(\begin{array}{c}\text{STANDARD DEVIATION OF VOLUME} - \\ \text{AVERAGE PARTICLE DIAMETER DISTRIBUTION}\end{array}\right)}{\left(\begin{array}{c}\text{ARITHMETIC VOLUME} - \\ \text{AVERAGE PARTICLE DIAMETER}\end{array}\right)} \times 100 \quad (1)$$

The CV value is calculated by the method described below.

When the CV value of the black toner is larger than those of the toners in other colors, because the black toner has a wider particle diameter distribution, most of the black toner having larger particle diameter is blocked by each layer thickness-controlling part in contact with each development roller, while the toners in other colors having smaller CV values, which are superior in fluidity, are respectively conveyed through the slit between the layer thickness-controlling part and the development roller by each development roller. As a result, the black toner deposited on the development rollers 14C, 14M, and 14Y is prevented from being supplied to the photosensitive drum 1 and subsequently developed.

The CV value of each toner is in the range of 15 to 35, and the difference in CV value between the black toner and other color toners is preferably 1 or more, from the point of efficiency of the black toner being blocked by each layer thickness-controlling part.

The black toner is described as the toner in a particular color having a smaller circularity in the present embodiment, but a toner in other color may be used instead. Although a black toner was selected as the toner having a smaller circularity in a particular color in the present embodiment, the toner is not limited to a single color toner. For example when multiple toners in four colors are used, three toners in three colors may be the toners having a smaller circularity in a particular color or the toners having a greater CV value in a particular color.

Preferably when the toner in a particular color is a magnetic toner and the toners in the other colors nonmagnetic toners, the magnetic toner is used as the toner higher in use frequency for improvement in the charging stability of the toner and the nonmagnetic toner is used as the toner in the other color for obtaining a color image superior in color saturation. Preferably when the toner in a particular color is a grinded toner and the toners in the other colors polymerized toners, the grinded toner is used as the toner higher in use frequency for improvement in the cleaning efficiency of the toner remaining on the photosensitive drum after transfer, and the polymerized toner is used as the toner in the other color for obtaining a high-quality image.

The volume-average particle diameter of the toner in a particular color is preferably larger than that of the toner in the other color. In particular, a difference in volume-average particle diameter at 1 μm or more is preferable from the efficiency of the black toner being blocked by each layer thickness-controlling part.

The volume-average particle diameter of the toner used in the present embodiment is preferably 3 to 14 μm, more preferably 6 to 12 μm, and, in particular, the particle diameter of the black toner is preferably 8 to 12 μm, and that of the toners in the other colors is 3 to 7 μm.

Because use of a grinded toner as black toner may lead to mixing of the black toner with a toner in the other color, it is preferable to form a cover over the black development roller 14K. Alternatively, only the black toner may be replenished properly.

Hereinafter, the other constituent units in the image forming apparatus 100 will be described.

The photosensitive drum 1 is a latent image-carrying member, on the surface of which an electrostatic latent image is formed. The photosensitive drum 1 in the present embodiment is, for example, an amorphous silicon photosensitive drum. The amorphous silicon photosensitive drum has, for example, a configuration of a conductive base material and a carrier injection-blocking layer containing Si, H, B, and O atoms, a carrier-exciting and transporting layer containing Si and H atoms (photoconductive layer), and a surface protective layer containing SiC, and H atoms formed thereon in that order.

The charging means 2 is a device placed at a position facing the photosensitive drum 1 for electrically charging the photosensitive drum 1 uniformly. The light-exposure means 3 is a device for forming an electrostatic latent image on the photosensitive drum 1 based on the manuscript image read out from the image data input unit not shown in the FIGURE.

The transfer device 5 is a device for transferring the toner image formed on the photosensitive drum 1 onto a recording medium such as paper that has an intermediate transfer belt 51, primary transfer rollers 52 and 53, a drive roller 55, secondary transfer counter roller 54, and a second transfer roller 56. The intermediate transfer belt 51 is wound around the primary transfer rollers 52 and 53, the drive roller 55, and the secondary transfer counter roller 54 endlessly and driven by the drive roller 55, and functions as a transfer body carrying the toner image transferred from the photosensitive drum 1 temporarily. The second transfer roller 56 is placed at the position facing the secondary transfer counter roller 54 on the peripheral surface of the intermediate transfer belt 51, and functions to transferring the toner image onto the recording medium.

The cleaning blade 6 is a device for removing the deposits such as toner remaining on the photosensitive drum 1, and a blade of a rubber having a hardness of 60 to 80 degrees (for example, polyurethane rubber) is pressed onto the photosensitive drum at a linear pressure of 10 to 40 N/m. The roller 8 has a function to recover and discharge the toner, while in contact with the surface of the photosensitive drum 1. The roller 8 is made of a metal shaft and a rubber layer having a hardness of 40 to 70 degrees covering the peripheral face thereof (for example, foamed rubber layer), and is pressed onto the photosensitive drum 1 under a load of 500 to 2,000 gf by springs (250 to 1,000 gf per spring), not shown in the FIGURE, at both ends of the bearing. The surface rotational velocity of the roller 8 in the contact area is set to 1 to 1.5 times larger than that of the photosensitive drum 1. The fixing unit 7 is a device fixing the transferred toner image on the recording medium. In FIG. 1, 11 represents a scraper for removing the toner remaining deposited on the roller 8; and 12 represents a recovery screw for recovering the toner deposited on the roller 8 or the toner fallen on the roller 8 as scraped with the cleaning blade 6. The recovery screw 12 discharges the recovered residual toner into a discharged toner container not shown in the FIGURE.

Hereinafter, operation of the image forming apparatus 100 will be described. When an image is formed, the photosensitive drum 1 is first electrostatically charged by the charging means 2. The rotary rack 41 in the rotary multicolor-developing unit 4 then revolves around the rotating shaft 40 at the center. The rotary rack 41 stops revolving at the position where the black color-developing device 4K corresponding to black color faces the photosensitive drum 1. An electrostatic latent image corresponding to black toner image is formed on the surface of the photosensitive drum 1 by exposure on photosensitive drum 1 by the light-exposure means 3. The electrostatic latent image obtained is developed to the black toner image by the black color-developing device 4K. The black toner image formed on the surface of the photosensitive drum 1 is transferred onto the transfer belt 51 by the transfer bias applied to the primary transfer rollers 52 and 53. After transfer of the black toner image onto the transfer belt 51, the rotary rack 41 revolves around the rotating shaft 40 at the center, for example, to the position where the cyan color-developing device 4M faces the development position. A cyan-colored toner image is then formed and transferred onto the transfer belt 51, similarly to the black toner image. Similarly, magenta and yellow toner images are also formed on the transfer belt 51. When the toner image is primary-transferred on the transfer belt 51, the second transfer roller 56 is separated from the transfer belt 51.

As described above, after a full color toner image is formed on the transfer belt 51, the second transfer roller 56 was brought into contact with the transfer belt 51. And at favorable timing, the recording medium such as paper is fed from the paper-feeding unit 20, for example, by a paper supply roller 9 and conveyed to the transfer position. The full color toner image formed on the transfer belt 51 is then transferred onto the recording medium by the secondary transfer bias applied to the second transfer roller 56.

The toner remaining on the photosensitive drum 1 is separated by the cleaning blade 6, and is discharged into a discharged toner container not shown in the FIGURE. The toner remaining on the transfer belt 51 is separated, while a transfer belt 51-cleaning device not shown in the FIGURE is brought into contact with the transfer belt 51 after secondary transfer, and discharged into a discharged toner container not shown in the FIGURE. The transfer belt 51-cleaning device not shown in the FIGURE is separated from the transfer belt 51, after the entire surface of the transfer belt 51 is cleaned.

When a monochromic image is formed, the rotary rack 41 does not revolve, and only the developing device 4K is brought to the position facing the photosensitive drum 1 for development. Other operations during image formation are the same as those during color image formation.

Hereinafter, the method of producing the toners to be supplied to the developing devices in the present embodiment will be described.

Examples of the toners to be supplied to the developing devices include toners produced by grinding classification method, suspension polymerization method, emulsion polymerization aggregation process, or the like. Polymerization methods give a toner higher in circularity. Alternatively, a toner obtained by melt granulation method or spray granulation method may be used instead.

In the case of the grinding classification method, a toner composition is prepared first by mixing a binder resin, a colorant, and a magnetic powder, and as needed a charge-controlling agent, a releasing agent and the like. The composition is then preblended, for example, in a Henschel mixer or a type-V mixer, and melt-blended in a melt-extruding machine such as twin screw extruder. The melt-extruded product was cooled, grinded roughly and finely, and classified as needed, to give toner particles having a particular circularity.

The binder resin, colorant, magnetic powder, charge-controlling agent and releasing agent are not particularly limited, and any known materials may be used.

The suspension polymerization method is a method of producing spherical toner particles higher in circularity, by dispersing a colorant, a wax, an antistatic agent, a crosslinking agent, and the like in a polymerizable monomer for the polymer resin; agitating the monomer composition after dispersion in an aqueous medium (e.g., water or a mixed solvent of water and a water-miscible solvent), forming particles having a suitable particle diameter; and heating the dispersion with a polymerization initiator, allowing polymerization of the polymerizable monomer.

The colorant, wax, antistatic agent, crosslinking agent and polymerization initiator are not particularly limited, and any known substances may be used.

Generally in the emulsion polymerization aggregation process, a resin dispersion containing a polymer resin is prepared by emulsion polymerization, and separately, an additive dispersion containing a colorant, a wax, an antistatic agent and the like in a solvent is prepared. Spherical toner particles are obtained by mixing these dispersions, forming aggregate particles having a diameter corresponding to that of toner particles, and fusing the aggregate particles under heat.

The binder resin or the polymerization resin is not particularly limited, and examples thereof include thermoplastic resins such as styrene-acrylic based resins, polyester based resins, polyacrylic based resins, polyethylene based resins, polypropylene based resins, vinyl chloride based resins, polyamide based resins, polyurethane based resins, polyvinylalcohol based resins, vinylether based resins, N-vinyl based resins, and styrene-butadiene based resins. Another resin may be used in combination with the resin above, or these resins may be used in combination of two or more.

The colorant contained in the toner is not particularly limited, and examples thereof include black colorants such as acetylene black, lamp black, and aniline black; magenta colorants including those listed in Color Index such as C.I. Pigment Red 81, C.I. Pigment Red 122, C.I. Pigment Red 57, C.I. Pigment Red 238, C.I. Pigment Red 49, C.I. Solvent Red 49, C.I. Solvent Red 19, C.I. Solvent Red 52, C.I. Basic Red 10, and C.I. Disperse Red 15; cyan colorants including those listed in Color Index such as C.I. Pigment Blue 15, C.I. Pigment Blue 15-1, C.I. Pigment Blue 15-3, C.I. Pigment Blue 16, C.I. Solvent Blue 55, C.I. Solvent Blue 70, C.I. Direct Blue 86, and C.I. Direct Blue 25; yellow colorants including nitro pigments such as naphthol yellow S, azo pigments such as Hanza Yellow 5G, Hanza Yellow 3G, Hanza Yellow G, Benzidine Yellow G, and Vulcan Fast Yellow 5G, inorganic pigments such as yellow iron oxide and Chinese yellow, those listed in Color Index such as C.I. Pigment Yellow 180, C.I. Pigment Yellow 74, C.I. Solvent Yellow 2, C.I. Solvent Yellow 6, C.I. Solvent Yellow 14, C.I. Solvent Yellow 15, C.I. Solvent Yellow 16, C.I. Solvent Yellow 19, and C.I. Solvent Yellow 21; and the like. These colorants may be used alone or in combination of two or more.

The colorant is blended in an amount normally of 2 to 20 parts by mass, preferably 3 to 10 parts by mass, with respect to the total amount of the toner binder resins or the polymerization resins.

An external additive is preferably added to the toner, for adjustment of the charge-controlling property and the flowability of the toner. Examples of the external additives include inorganic fine powders such as of silica, titanium oxide, aluminum oxide, zinc oxide, magnesium oxide, and calcium carbonate; organic fine powders such as of polymethyl methacrylate; fine powders of fatty acid metal salts such as zinc stearate; and the like. Among them, use of an inorganic fine powder, in particular silica, is particularly preferable.

The amount of the external additive added is preferably 0.05 to 4.0 parts by mass with respect to 100 parts by mass of the toner particles. The external additive and the toner particle are mixed, for example, in a Henschel mixer, type-V mixer, tumbler mixer, hybridizer, or the like.

In this embodiment, the image forming apparatus having the rotary multicolor-developing unit was explained in detail. However, the present Invention may be applied to an other type of an image forming apparatus such as an image forming apparatus having developing devices separated each other instead of the multicolor-developing unit.

Hereinafter, the present invention will be described in detail with reference to Examples, but it should be understood that the present invention is not limited to the following Examples.

EXAMPLES

The methods of determining the circularity and the CV value of toner particles used in Examples and Comparative Examples will be described first.

(Measurement of Circularity)

The circularity of toner particle was determined by using a flow particle image analyzer (FPIA-2100: manufactured by Sysmex).

(Measurement of Coefficient of Variation (Cv Value) of Particle Diameter Distribution)

The volume-average diameter distribution of the toner was determined by using a particle-diameter distribution analyzer (Multisizer III (trade name) manufactured by Coulter). Measurement was performed in the following manner:

First, aqueous 1% NaCl solution was prepared with sodium chloride (analytical grade). 0.1 to 5 ml of an alkylbenzenesulfonate salt was added to 100 to 150 ml of the aqueous 1% NaCl solution.

0.5 to 50 mg of the toner to be analyzed was added to the solution obtained, and the mixture was suspended, to give a toner suspension. The suspension was further dispersed in an ultrasonic homogenizer for 1 to 3 minutes. The volume particle diameter distribution of the toner particles was determined by using Multisizer III at an aperture of 100 μm, and the arithmetic volume-average particle diameter and the standard deviation of the volume particle diameter distribution were determined from the results obtained.

The CV value was calculated according to Formula (1) above.

Hereinafter, the methods of preparing the toners used in Examples and Comparative Examples will be described.

(Preparation of Polymerized Black Toner)

A liquid mixture of 80 parts by mass of styrene, 20 parts by mass of 2-ethylhexyl methacrylate, 5 parts by mass of carbon black (MA-100, manufactured by Mitsubishi Chemical Corp.), 3 parts by mass of low-molecular weight polypropylene (Biscol 660P, manufactured by Sanyo Chemical Industries), 2 parts by mass of a charge-controlling agent (Bontron S-34, manufactured by Orient Chemical Industries), and 1 parts by mass of divinylbenzene (crosslinking agent) was dispersed sufficiently in a ball mill, and 2 parts by mass of 2,2-azobis(2,4-dimethylvaleronitrile) was added thereto as polymerization initiator. The liquid mixture was then added to 400 parts by mass of ion-exchange water; 5 parts by mass of tribasic calcium phosphate and 0.1 parts by mass of sodium dodecylbenzenesulfonate were added thereto additionally as suspension stabilizers; the mixture was stirred in a TK homomixer (manufactured by Tokushu Kika Kogyo) at a rotational frequency of 7,000 rpm for 60 minutes, to give a suspension. The suspension was heated while stirred under a nitrogen environment, while the agitating blade was rotated at a rotational frequency of 100 rpm at 70° C. for 10 hours, allowing polymerization of the monomer component. The dispersion obtained was washed with acid, for removal of tribasic calcium phosphate. The resulting dispersion was filtered, and the recovered powder was washed and dried, to give toner mother particles.

The circularity of the toner mother particle was 0.97. As for the particle diameter distribution, the toner mother particles had a volume-average particle diameter of 7.1 μm and a CV value of 23%.

0.8 part by mass of titanium oxide 1: MT-100SA (manufactured by Tayca Corporation, average primary particle diameter: 15 nm) and 0.8 part by mass of silica 1: NY50 (manufactured by Nippon Aerosil Co., Ltd., average primary particle diameter: 30 nm) were added to 100 parts by mass of the toner mother particles, and the mixture was mixed in a FM mixer (manufactured by Mitsui Mining Com.) at a peripheral speed of 3,500 mm/second for 10 minutes, to give a black polymerized toner.

(Preparation of Polymerized Color Toners)

Yellow, magenta, and cyan toners were prepared by a method similar to that for the black toner, except that carbon black was replaced with the following colorant. The circularities of the color toners obtained in yellow, magenta, and cyan were all 0.97, and the CV value of the yellow toner was 23%; magenta toner, 24%; and cyan toner, 23%.

Yellow pigment: C.I. Pigment Yellow 74

Magenta pigment: C.I. Pigment Red 57

Cyan pigment: C.I. Pigment Blue 15-1

(Preparation of Magnetic Black Toner by Grinding)

First, production of the polyester resin used as binder resin will be described.

[Preparation of Polyester Resin A]

2,000 g of bisphenol A propyleneoxide 2.2 mole adduct, 800 g of bisphenol A ethyleneoxide 2.2 mole adduct, 500 g of terephthalic acid, 600 g of n-dodecenylsuccinic acid, 350 g of trimellitic anhydride, and 4 g of dibutyltin oxide were placed in a reaction vessel; the mixture was stirred, allowing condensation reaction to proceed, under a condition of 220° C. for 8 hours in a nitrogen atmosphere, and then additionally under a reduced pressure, allowing polymerization of a polyester resin A until the softening point of the resin reached 155° C. The polyester resin A thus obtained had a glass transition point (Tg) of 60° C., a softening point of 150° C., an acid value of 7.0, and a gel fraction of 30%.

[Preparation of Polyester Resin B]

2,800 g of bisphenol A propyleneoxide 2.2 mole adduct, 400 g of terephthalic acid, 650 g of fumaric acid, and 4 g of dibutyltin oxide were placed in a reaction vessel; the mixture was stirred under a condition of 220° C. for 8 hours in a nitrogen atmosphere, allowing condensation reaction to proceed, and additionally under a reduced pressure, until the softening point of the resin reached 90° C. The polyester resin B thus obtained had a glass transition point (Tg) of 50° C., a softening point of 100° C., an acid value of 4.0, and a gel fraction of 0%.

[Melt-Extrusion]

30 parts by mass of polyester resin A, 70 parts by mass of polyester resin B, 75 parts by mass of a magnetic powder (product name: MTSB-905, manufactured by Toda Kogyo Corp.), 3 parts by mass of a charge-controlling agent CCA (trade name: Bontron No. 1, manufactured by Orient Chemical Industries), 8 parts by mass of a charge-controlling resin (quaternary ammonium salt-containing styrene-acryl copolymer; FCA196 manufactured by Fujikura Kasei) and, 3 parts by mass of an ester wax (high purity solid fatty acid ester, a condensation product from a straight-chain monocarboxylic acid (having 20 to 30 carbon atoms) and a straight-chain saturated monovalent alcohol (having 20 to 30 carbon atoms), having a melting temperature in the range of 75 to 85° C. and a impurity content of 0.01% or less) as a wax component were mixed in a Henschel mixer.

The mixture was then blended additionally in a biaxial extruder (cylinder temperature setting: 100° C.) and grinded in a feather mill into coarse particles. The particles were then further grinded in a turbo-mill and classified in an air-flow classifier, to give toner particles. The circularity of the toner particle obtained was 0.95. As for the particle diameter distribution, the toner particles had a volume-average particle diameter of 8.0 μm and a CV value of 28%.

One part by mass of silica (trade name: RA200HS, manufactured by Nippon Aerosil) and 1.5 parts by mass of titanium oxide (trade name: EC100T1, manufactured by Titan Kogyo) were added to 100 parts by mass of the toner particles obtained, and the mixture was mixed in a Henschel mixer, to give a magnetic black toner.

Example 1

Image characteristics were evaluated by using a test printing machine shown in FIG. 1 manufactured by Kyocera Mita Corp. containing the rotary multicolor-developing unit 4.

The photosensitive drum 1 of the printer is made of amorphous silicon; the diameter of the photosensitive drum was 30 mm; and as for development rollers 14K, 14C, 14M, and 14Y, magnetic drums having a diameter of 16 mm were used for magnetic toners, while nonmagnetic drums having a diameter of 14 mm for nonmagnetic toners. Each of the layer thickness-controlling parts 24C, 24M, and 24Y was in contact with the development roller 14C, 14M, or 14Y at a linear pressure of approximately 0.25 kg/mm, while the layer thickness-controlling part 24K was not in contact with the development roller 14K.

The magnetic black toner, yellow polymerized toner, magenta polymerized toner, and cyan polymerized toner were fed in particular amounts respectively to black color-developing device 4K, cyan color-developing device 4C, magenta color-developing device 4M, and yellow developing device 4Y.

A solid image in four colors was printed, while the magnetic black toner was dropped on the development rollers 14C, 14M, and 14Y.

As a result, even when the magnetic black toner added deposited on the development rollers 14C, 14M, and 14Y, the magnetic black toner on the development rollers was collected in respective developing devices and absent on the respective development rollers after two or three revolutions of the respective development rollers. The image obtained also stopped showing color mixing soon.

Example 2

A test was performed in a similar manner to Example 1, except that the magnetic black toner was dropped in a certain amount on cyan color-developing device 4C, magenta color-developing device 4M, and yellow developing device 4Y, instead of dropping the magnetic black toner on the development rollers 14C, 14M, and 14Y.

As a result, the black toner on each development roller disappeared and a layer only of the corresponding toner was formed in 1 minute.

Comparative Example

A test was performed in a similar manner to Example 1, except that the magnetic black toner was replaced with the polymerized black toner. As a result, there was image staining, and there was black color mixing present in the color image region of the image obtained. The image staining continued, until the added polymerized black toner disappeared.

Comparison of the results of Examples 1 and 2 with Comparative Example shows the followings:

When a magnetic black toner having a smaller circularity or a greater CV value is used as in Examples 1 and 2, if the magnetic black toner deposited on the development roller deposits on the development rollers 14C, 14M, and 14Y, the toner is blocked respectively by each layer thickness-controlling part, does not migrate below the layer thickness-controlling part, and thus, is contained in each developing device, and does not show up on each development roller, and the color mixing in the obtained image disappears soon. On the other hand, when a polymerized black toner having a larger circularity or a smaller CV value is used as in Comparative Example, the toner, which is superior in fluidity, migrates under each layer thickness-controlling part easily. As described above, in the image forming apparatus according to the present invention, there are no troubles by color mixing and no image staining even if there was toner leakage and the toner is fed to developing devices in other colors.

An aspect of the present invention is, as described above, an image forming apparatus of forming a color image, comprising multiple developing devices each containing a toner different in color, wherein: each of the developing devices has a toner carrier and a layer thickness-controlling part placed at the position facing the toner carrier; among the toners different in color, the circularity of the toner in a particular color is smaller than that of the toners in the other colors; and the layer thickness-controlling parts of the developing devices containing the toners in the other colors are in contact with the toner carrier at a particular linear pressure.

In the image forming apparatus above, it is possible to prevent leakage of a toner and the phenomenon of color mixing caused by contamination of the toners in other developing devices with the toner and thus to prevent image staining during image formation.

Another aspect of the present invention is an image forming apparatus of forming a color image, comprising multiple developing devices each containing a toner different in color, wherein: each of the developing devices has a toner carrier and a layer thickness-controlling part placed at the position facing the toner carrier; among the toners different in color, the coefficient of variance (CV value) of the particle diameter distribution of the toner in a particular color defined by the following Formula (1) is larger than that of the toners in the other colors; and the layer thickness-controlling parts of the developing devices containing the toners in the other colors are in contact with the toner carrier at a particular linear pressure.

$$CV\ \text{VALUE} = \frac{\left(\begin{array}{c}\text{STANDARD DEVIATION OF VOLUME} - \\ \text{AVERAGE PARTICLE DIAMETER DISTRIBUTION}\end{array}\right)}{\left(\begin{array}{c}\text{ARITHMETIC VOLUME} - \\ \text{AVERAGE PARTICLE DIAMETER}\end{array}\right)} \times 100 \quad (1)$$

In the image forming apparatus above, it is possible to prevent leakage of a toner and the phenomenon of color mixing caused by contamination of the toners in other developing devices with the toner and thus to prevent image staining during image formation.

The layer thickness-controlling part in the developing device containing the toner in a particular color is preferably not in contact with the toner carrier, for smoother supply of the toner in a particular color.

The toner in a particular color is preferably a single color toner, in particular a black color. Generally, the black toner is used in printing more frequently than toners in other colors, and thus, scattered more easily. Accordingly, it is possible to prevent the phenomenon of color mixing between black and other colors, which is often encountered during image formation, and thus to prevent image staining more effectively, by using a black toner as the toner in a particular color.

The toner in a particular color is preferably a grinded toner, and the toners in the other colors, polymerized toners. Polymerized toners, which are relatively higher in circularity and have lower CV value, are preferable.

In addition, the toner in a particular color is preferably a magnetic toner, and the toners in the other colors are nonmagnetic toners.

The volume-average particle diameter of the toner in a particular color is preferably larger than that of the toners in the other colors.

The image forming apparatus has preferably a rotary developing unit having the multiple developing devices each containing a toner carrier that are placed along the external surface of a rotor and developing a latent image on the latent image-holding member selectively by moving one of the developing devices by revolution to the development position.

This application is based on patent application No. 2006-078934 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus for forming a color image, comprising multiple developing devices each containing a toner different in color, one of the developing devices containing a black toner, wherein:

each of the developing devices has a toner carrier and a layer thickness-controlling part placed at a position facing the toner carrier;

among the toners different in color, the circularity of the black toner is smaller than the circularity of the toners in the other colors;

the layer thickness-controlling parts of the developing devices containing the toners in the other colors are in contact with the toner carrier at a particular linear pressure; and the black toner is a magnetic toner and the toners in the other colors are nonmagnetic toners.

2. The image forming apparatus according to claim 1, wherein the layer thickness-controlling part in the developing device containing the black toner is not in contact with the toner carrier.

3. The image forming apparatus according to claim 1, wherein the black toner is a grinded toner and the toners in the other colors are polymerized toners.

4. The image forming apparatus according to claim 1, wherein the volume-average particle diameter of the black toner is greater than that of the toners in the other colors.

5. The image forming apparatus according to claim 1, wherein the image forming apparatus has a rotary developing unit having the multiple developing devices each containing a toner carrier that are placed along the external surface of a rotor and developing a latent image on the latent image-holding member selectively by moving one of the developing devices by revolution to the development position.

6. An image forming apparatus for forming a color image, comprising multiple developing devices each containing a toner different in color, wherein:

each of the developing devices has a toner carrier and a layer thickness-controlling part placed at the position facing the toner carrier;

among the toners different in color, the coefficient of variance (CV value) of the particle diameter distribution of the toner in a particular color defined by the following Formula (1):

$$CV\ \text{VALUE} = \frac{\left(\begin{array}{c}\text{STANDARD DEVIATION OF VOLUME} - \\ \text{AVERAGE PARTICLE DIAMETER DISTRIBUTION}\end{array}\right)}{\left(\begin{array}{c}\text{ARITHMETIC VOLUME} - \\ \text{AVERAGE PARTICLE DIAMETER}\end{array}\right)} \times 100 \quad (1)$$

is larger than that of the toners in the other colors;

the layer thickness-controlling parts of the developing devices containing the toners in the other colors are in contact with the toner carrier at a particular linear pressure; and the volume-average particle diameter of the toner in the particular color is greater than that of the toners in the other colors.

7. The image forming apparatus according to claim 6, wherein the layer thickness-controlling part in the developing device containing the toner in a particular color is not in contact with the toner carrier.

8. The image forming apparatus according to claim 6, wherein the particular color is a single color.

9. The image forming apparatus according to claim 6, wherein the particular color is only a black color.

10. The image forming apparatus according to claim 6, wherein the toner in a particular color is a grinded toner and the toners in the other colors are polymerized toners.

11. The image forming apparatus according to claim 6, wherein the toner in a particular color is a magnetic toner and the toners in the other colors are nonmagnetic toners.

12. The image forming apparatus according to claim 6, wherein the image forming apparatus has a rotary developing unit having the multiple developing devices each containing a toner carrier that are placed along the external surface of a rotor and developing a latent image on the latent image-holding member selectively by moving one of the developing devices by revolution to the development position.

13. An image forming apparatus for forming a color image, comprising multiple developing devices each containing a toner different in color, wherein:

each of the developing devices has a toner carrier and a layer thickness-controlling part placed at a position facing the toner carrier;

among the toners different in color, circularity of the toner in a particular color is smaller than circularity of the toners in the other colors; and the layer thickness-controlling parts of the developing devices containing the toners in the other colors are in contact with the toner carrier at a particular linear pressure, wherein the volume-average particle diameter of the toner in the particular color is greater than that of the toners in the other colors.

* * * * *